United States Patent [19]

Prince

[11] Patent Number: 4,951,520

[45] Date of Patent: Aug. 28, 1990

[54] SINGLE LEVER CONTROL

[75] Inventor: Anthony P. Prince, Waukegan, Ill.

[73] Assignee: Outboard Marine Corporation, Waukegan, Ill.

[21] Appl. No.: 272,544

[22] Filed: Nov. 17, 1988

[51] Int. Cl.[5] ..... B60K 41/04

[52] U.S. Cl. ..... 74/471 R; 192/0.096; 74/876

[58] Field of Search ..... 74/273 R, 271 R, 876, 74/878; 192/0.096, 0.098

[56] References Cited

U.S. PATENT DOCUMENTS

| | | | |
|---|---|---|---|
| 880,382 | 2/1908 | Keith . | |
| 1,687,567 | 10/1928 | Johnson . | |
| 2,907,421 | 10/1959 | Morse et al. | 192/0.096 |
| 3,057,221 | 10/1962 | Smith . | |
| 3,115,050 | 12/1963 | Marr . | |
| 3,127,785 | 4/1964 | Morse et al. . | |
| 3,130,598 | 4/1964 | Burnham . | |
| 3,309,938 | 3/1967 | Pervier . | |
| 3,491,614 | 1/1970 | Saunders et al. . | |
| 3,508,634 | 4/1970 | Fiddler . | |
| 3,511,117 | 5/1970 | Morse . | |
| 3,530,736 | 9/1970 | Houk . | |
| 3,556,270 | 1/1971 | Comment . | |
| 3,581,603 | 6/1971 | Farrington . | |
| 3,741,044 | 6/1973 | Baba . | |
| 3,741,045 | 6/1973 | Kobayashi | 192/0.098 X |
| 3,842,689 | 10/1974 | Bagge | 192/0.096 X |
| 3,842,695 | 10/1974 | Farrington . | |
| 3,857,299 | 12/1974 | Morrison . | |
| 4,027,555 | 6/1977 | Rauchle et al. . | |
| 4,090,598 | 5/1978 | Prince . | |
| 4,106,604 | 8/1978 | Baba . | |
| 4,131,037 | 12/1978 | Olsen et al. . | |
| 4,137,799 | 2/1979 | Olsen et al. . | |
| 4,144,956 | 3/1979 | Baba . | |
| 4,205,738 | 6/1980 | Baba . | |
| 4,253,349 | 3/1981 | Floeter et al. | 192/0.096 X |
| 4,467,665 | 8/1984 | Katayama et al. . | |
| 4,503,728 | 3/1985 | Fischer et al. . | |
| 4,632,232 | 12/1986 | Kobl et al. . | |
| 4,646,588 | 3/1987 | Winter | 74/876 |
| 4,648,497 | 3/1987 | Prince . | |

*Primary Examiner*—Peter A. Aschenbrenner

*Attorney, Agent, or Firm*—Michael, Best & Friedrich

[57] ABSTRACT

A single lever control comprising a housing having a first recess, a shaft pivotably supported by the housing and having an axial bore, a shift member pivotably supported by the housing coaxially with the shaft and adapted to be operably connected to a clutch, the shift member being movable relative to a neutral position and having a second recess located radially inwardly of the first recess and aligned with the first recess when the shift member is in the neutral position, a plunger housed in the bore for movement axially of the shaft between first and second positions, and a mechanism for fixing the shift member to the shaft and permitting rotation of the shift member relative to the housing when the plunger is in the first position, and for fixing the shift member to the housing and permitting rotation of the shaft relative to the shift member when the plunger is in the second position, the mechanism including a member at least partially housed in the second recess, and a mechanism for moving the member radially outwardly of the first recess and into the second recess when the shift member is in the neutral position and in response to movement of the plunger to the second position.

34 Claims, 6 Drawing Sheets

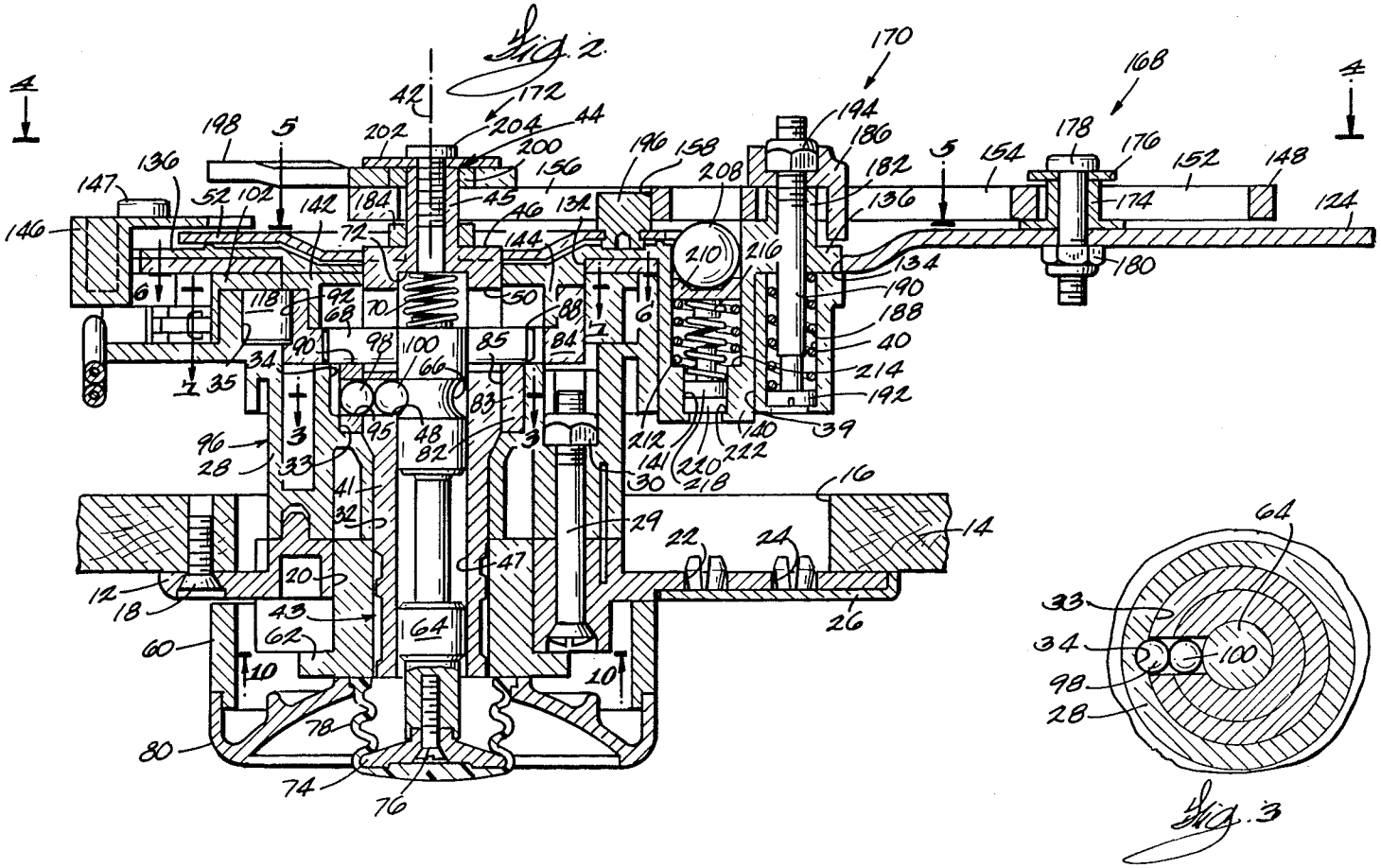

SINGLE LEVER CONTROL

BACKGROUND OF THE INVENTION

The invention relates to single lever controls, and, more particularly, to single lever controls for operating the clutch and throttle of a marine propulsion device.

A conventional single lever control includes a control lever movable between a neutral position and a drive position. When the lever is in the neutral position, the throttle is closed and the clutch is in neutral. Initial movement of the lever from the neutral position toward the drive position shifts the clutch into drive but does not open the throttle. After the clutch is shifted into drive, subsequent movement of the lever toward the drive position opens the throttle.

It is known to provide such a single lever control with means for affording warm-up of the engine, i.e., for permitting the throttle to be opened without shifting the clutch into drive. Such means can include a button which normally extends outwardly of the single lever control and which is pushed inwardly to afford engine warm-up. See, for example, U.S. Pat. No. 4,027,555, issued June 7, 1977.

U.S. Pat. No. 4,648,497, which is issued to the assignee hereof, discloses a single lever control including a control lever that is pulled outwardly to afford engine warm-up.

Attention is also directed to the following U.S. Pat. Nos.:

| | | | |
|---|---|---|---|
| 880,382 | 3,491,614 | 3,741,045 | 4,144,956 |
| 1,687,567 | 3,508,634 | 3,842,695 | 4,205,738 |
| 3,057,221 | 3,511,117 | 3,857,299 | 4,467,665 |
| 3,115,050 | 3,530,736 | 4,090,598 | 4,503,728 |
| 3,127,785 | 3,556,270 | 4,106,604 | 4,632,232 |
| 3,130,598 | 3,581,603 | 4,131,037 | |
| 3,309,938 | 3,741,044 | 4,137,799 | |

SUMMARY OF THE INVENTION

The invention provides a single lever control comprising a housing having therein a first recess, a shaft pivotably supported by the housing and having therein an axial bore, a shift member pivotably supported by the housing coaxially with the shaft and adapted to be operably connected to a clutch, the shift member being movable relative to a neutral position and having therein a second recess located radially inwardly of the first recess and aligned with the first recess when the shift member is in the neutral position, a plunger housed in the bore for movement axially of the shaft between first and second positions, and means for fixing the shift member to the shaft and permitting rotation of the shift member relative to the housing when the plunger is in the first position, and for fixing the shift member to the housing and permitting rotation of the shaft relative to the shift member when the plunger is in the second position, the means including a member at least partially housed in the second recess, and means for moving the member radially outwardly of the first recess and into the second recess when the shift member is in the neutral position and in response to movement of the plunger to the second position.

The invention also provides a single lever control comprising a housing, a shaft pivotably supported by the housing and having therein an axial bore, a shift member coaxial with the shaft and adapted to be operably connected to a clutch, a plunger housed in the bore for movement axially of the shaft between outward and inward positions, and means for fixing the shift member to the shaft and permitting rotation of the shift member relative to the housing when the plunger is in the outward position, and for fixing the shift member to the housing and permitting rotation of the shaft relative to the shift member when the plunger is in the inward position, the means including a member which directly engages both the housing and the shift member when the plunger is in the inward position.

The invention also provides a single lever control comprising a housing, a lever supported by the housing for pivotal movement relative to a neutral position and adapted to be operably connected to a clutch, detent means exerting a force on the lever for releasably holding the lever in the neutral position, and means for adjusting the magnitude of the force.

The invention also provides a single lever control comprising a housing, a lever supported by the housing for pivotal movement between a forward position, a neutral position, and a rearward position, a shaft fixed to the lever for common movement therewith, the shaft having therein first, second, and third recesses, the second recess being larger than the first and third recesses, a ball which is supported by the housing and which is aligned with the first recess when the lever is in the forward position, is aligned with the second recess when the lever is in the neutral position, and is aligned with the third recess when the lever is in the rearward position, and means for biasing the ball toward the member so that the ball extends into an aligned one of the recesses.

The invention also provides a single lever control comprising a housing, a lever supported by the housing for pivotal movement relative thereto about an axis, a throttle member supported by the housing for translational movement relative thereto along a line substantially perpendicular to and intersecting the axis, the throttle member being adapted to be operably connected to a throttle, and friction means for resisting movement of the throttle member.

The invention also provides a single lever control comprising a housing, a lever supported by the housing for pivotal movement relative thereto, a throttle member movably supported by the housing and adapted to be operably connected to a throttle, means for guiding movement of the throttle member relative to the housing and including friction means for resisting movement of the throttle member relative to the housing, and means for causing movement of the throttle member relative to the housing in response to pivotal movement of the lever relative to the housing.

The invention also provides a single lever control comprising a housing, a lever supported by the housing for pivotal movement relative thereto, a throttle member movably supported by the housing and adapted to be operably connected to a throttle, means for causing movement of the throttle member relative to the housing in response to pivotal movement of the lever relative to the housing, and friction means for resisting movement of the throttle member relative to the housing, the friction means including a friction member engaging the throttle member, a spring exerting a force on the friction member so as to bias the friction member against the throttle member, and means for adjusting the length of the spring.

The invention also provides a single lever control adapted to be connected to a control cable including an inner core, and an outer sleeve generally cylindrical trunnion, the single lever control comprising a housing, a lever supported by the housing for pivotal movement relative thereto and adapted to be operably connected to the inner core of the cable, and means for securing the trunnion to the housing for pivotal movement relative thereto, the securing means including first and second members each partially defining a generally cylindrical pocket for housing the trunnion, and means for fixing the first and second members relative to the housing.

The invention also provides a single lever control comprising a housing, a cable including an inner core adapted to be operably connected to a clutch, an outer sleeve surrounding the core, and a generally cylindrical trunnion removably secured to the sleeve against axial movement relative thereto, means for securing the trunnion to the housing for pivotal movement relative thereto, and a lever supported by the housing for pivotal movement relative thereto and operably connected to the core.

The invention also provides a single lever control adapted to be connected to a control cable including an inner core, and an outer sleeve surrounding the core and having fixed thereto a generally cylindrical trunnion, the single lever control comprising a support plate having therein spaced first and second apertures, a lever supported by the plate for pivotal movement relative thereto and adapted to be operably connected to the core of the cable, means for supporting the trunnion, the supporting means having therein a third aperture aligned with the first aperture and having thereon a projection received in the second aperture, and connecting means extending through the first and third apertures for securing the supporting means to the plate.

The invention also provides a single lever control comprising a housing, a control lever supported by the housing for pivotal movement relative thereto about an axis, a throttle member supported by the housing for translational movement relative thereto, means for moving the throttle member in response to pivotal movement of the control lever, a throttle lever supported by the housing for pivotal movement relative thereto about the axis and adapted to be operably connected to a throttle, and means for causing pivotal movement of the throttle lever in response to movement of the throttle member.

The invention also provides a single lever control comprising a housing, a control lever supported by the housing for pivotal movement relative thereto, a throttle member movably supported by the housing and adapted to be operably connected to a throttle, the throttle member having therein first and second slots, and a cam slot located intermediate the first and second slots, means for guiding movement of the throttle member relative to the housing and including first and second guide means supported by the housing and respectively received in the first and second slots, and means for causing movement of the throttle member relative to the housing in response to pivotal movement of the lever relative to the housing, the means for causing movement of the throttle member including a member fixed to the lever for common movement therewith and received in the cam slot.

Other features and advantages of the invention will become apparent to those skilled in the art upon review of the following detailed description, claims and drawings.

DESCRIPTION OF THE DRAWINGS

FIG. 2 is a view taken along line 2—2 in FIG. 1.

FIG. 3 is a view taken along line in FIG. 2.

Figure 16:
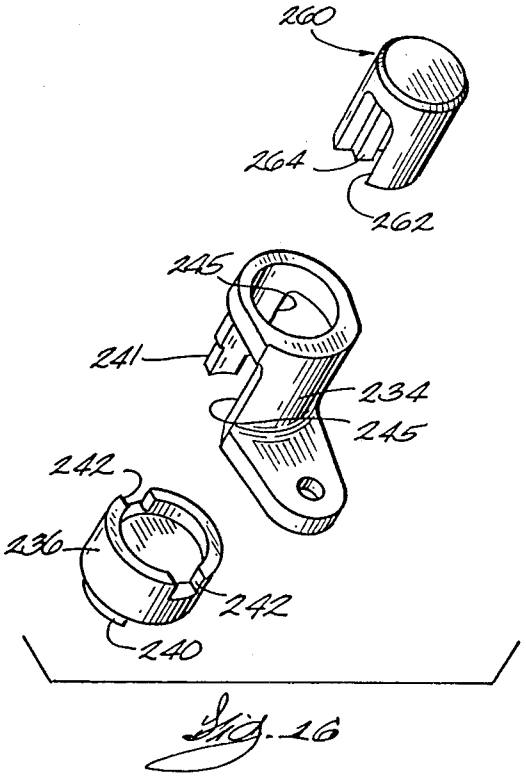
FIG. 16 is an exploded perspective of the assembly shown in FIG. 15.

Before one embodiment of the invention is explained in detail, it is to be understood that the invention is not limited in its application to the details of construction and the arrangements of components set forth in the following description or illustrated in the drawings. The invention is capable of other embodiments and of being practiced or being carried out in various ways. Also, it is to be understood that the phraseology and terminology used herein is for the purpose of description and should not be regarded as limiting.

DESCRIPTION OF THE PREFERRED EMBODIMENT

A single lever control 10 embodying the invention is illustrated in the drawings.

Figure 10:
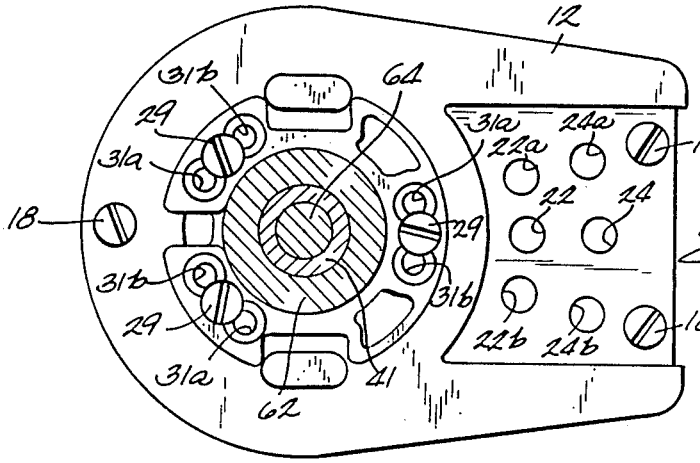
FIG. 10 is a view taken along line 10—10 in FIG. 2, with the cover removed from the mounting plate.

The control 10 comprises (see FIGS. 1, 2 and 10) a mounting plate 12 mounted on a generally vertical wall 14 (shown only in FIG. 2), such as a gunwale, of a boat. The wall 14 has therein an opening 16 which is covered by the mounting plate 12, and the mounting plate 12 is preferably secured to the wall 14 by screws 18. The mounting plate 12 has therein a generally cylindrical bore 20 and apertures 22 and 24, the reason for which is explained hereinafter. The control 10 also comprises (see FIGS. 1 and 2) a cover 26 which is removably secured to the mounting plate 12 and which covers the apertures 22 and 24.

Figure 1:
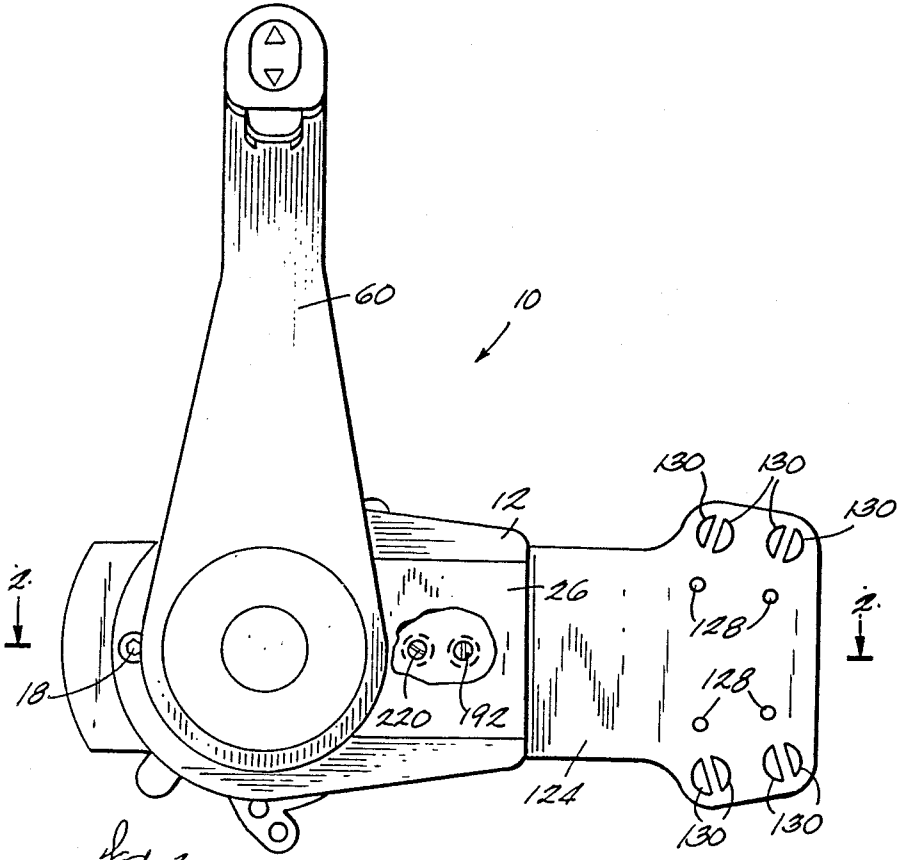
FIG. 1 is a side elevational view of a single lever control embodying the invention.

The control 10 also comprises (see FIG. 2) a housing 28 located on the opposite side of the wall 14 from the mounting plate 12. The housing 28 is secured to the mounting plate 12 by suitable means such as bolts 29 and nuts 30 (FIGS. 1 and 2). The housing 28 also includes (see FIG. 2) a generally cylindrical inner wall 32 coaxial with the bore 20 in the mounting plate 12, a generally cylindrical inner wall 33 coaxial with the wall 31 and having therein a recess 34 (FIGS. 2 and 3), and a generally cylindrical inner wall 35 coaxial with the walls 32 and 33. The wall 35 has therein (see FIG. 2) recesses 36, 37 and 38. The housing 28 also has therein (see FIG. 2) a generally cylindrical bore 39 coaxial with the aperture 22 in the mounting plate 12, and a generally cylindrical bore 40 coaxial with the aperture 24 in the mounting plate 12.

Figure 5:
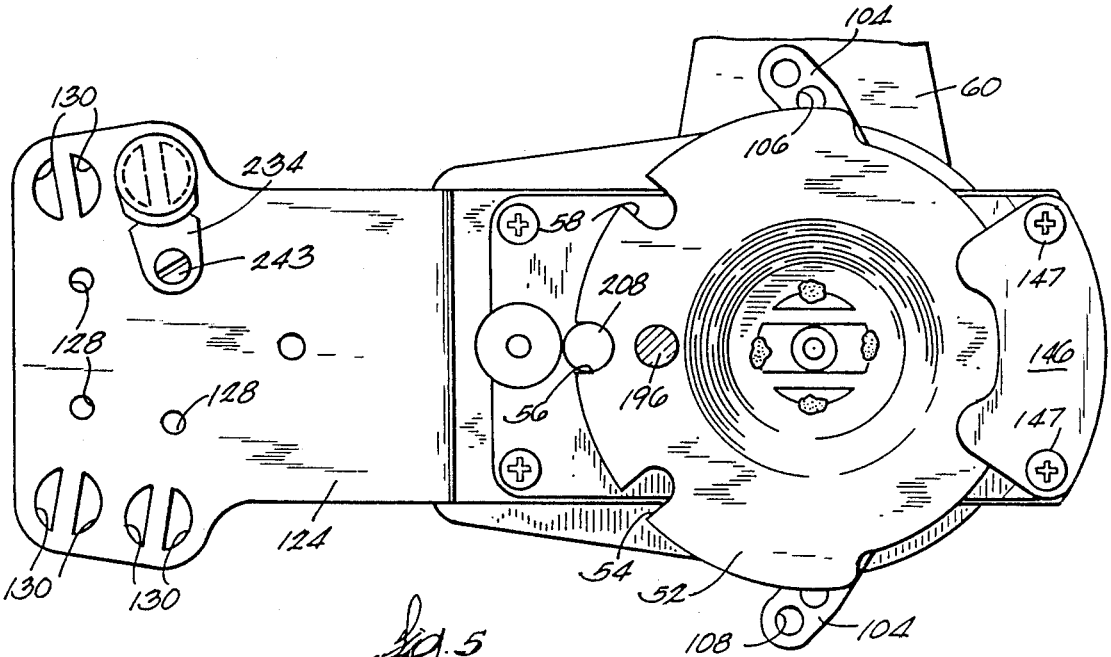
FIG. 5 is a view taken generally along line 5—5 in FIG. 2.

The control 10 also comprises means affording variation of the orientation of the housing 28 relative to the mounting plate 12. While various suitable means can be employed, in the preferred embodiment, such means includes, in the mounting plate 12, apertures 31*a*, 22*a* and 24*a*, and apertures 31*b*, 22*b* and 24*b*. When the bolts 29 are inserted through the aperture 31*a*, the orientation of the housing 28 relative to the mounting plate 12 is approximately 15° from the orientation shown in FIG. 1, and the apertures 22*a* and 24*a* are coaxial with the bores 39 and 40, respectively. When the bolts 29 are inserted through the apertures 31*b*, the orientation of the housing 28 relative to the mounting plate 12 is approximately 15° in the other direction from the orientation shown in FIG. 1, and the apertures 22*b* and 24*b* are coaxial with the bores 39 and 40, respectively The control 10 also comprises (see FIGS. 2 and 10) a drive shaft 41 supported by the housing 28 for pivotal movement relative thereto about an axis 42. The shaft 41 is movable, in the clockwise direction as viewed in FIG. 10, between a full forward position, a forward clutch-engaged position, a first or neutral position, a rearward clutch-engaged position, and a full rearward position. As shown in FIG. 2, the shaft 41 is pivotably supported within the wall 32 and has an externally splined first end 43 extending outwardly of one side of the housing 28 and an opposite second end 44 extending outwardly of the other side of the housing 28. The shaft 41 includes, adjacent the second end 44 thereof, a reduced-diameter portion 45 and a shoulder 46. The shaft 41 has therein an axial bore 47, a radially extending first recess or aperture 48 communicating with the bore 47, and a diametrically extending slot 50 communicating with the bore 47. The shaft 41 has integrally connected thereto, adjacent the second end 44 thereof, a generally circular plate 52 that pivots in common with the shaft 41. The plate 52, which can be considered part of the shaft 41, has therein (see FIG. 5) first, second, and third recesses 54, 56, and 58, respectively. The second or middle recess 56 is larger than the first and third or outer recesses 54 and 58.

The control 10 also comprises (see FIGS. 1 and 2) a control lever or handle 60 fixed to the shaft 41 for common pivotal movement therewith. The control handle 60 is movable, in the clockwise direction as viewed in FIG. 1, between full forward, forward clutch-engaged, neutral, rearward clutch-engaged and full rearward positions corresponding to the identically designated positions of the shaft 41. In the preferred embodiment, the lever 60 includes an internally splined hub 62 mounted on the externally splined first end 43 of the shaft 41. Accordingly, pivotal movement of the lever 60 causes pivotal movement of the shaft 41.

The control 10 also comprises (see FIG. 2) a plunger or rod 64 slideably housed in the axial bore 47 in the shaft 41 for movement axially of the shaft 41 between a first or outward position and a second or inward position. The plunger 64 has an inner end located inside the bore 47, and an outer end located outwardly of the shaft 41. The plunger 64 has therein a circumferential groove 66 that is aligned with the first aperture 48 when the plunger 64 is in the outward position. The plunger 64 has thereon a pin or key 68 extending diametrically and through the slot 50 in the shaft 41.

The control 10 also comprises means for biasing the plunger 64 toward the first or outward position. While various suitable biasing means can be employed, in the preferred embodiment, such means includes (see FIG. 2) a spring 70 extending between the inner end of the plunger 64 and a shoulder 72 within the bore 47.

The control 10 also comprises (see FIG. 2) a knob 74 secured to the outer end of the plunger 64 by suitable means, such as a screw 76, and a flexible boot or bellows 78 covering the knob 74 and the portion of the plunger 64 extending outwardly of the shaft 41. The control 10 further comprises a cover 80 which is secured to the hub 62 of the lever 60 and which secures the boot 78 to the hub 62.

The control 10 also comprises (see FIGS. 2 and 6–9) a shift member or cam 82 pivotably supported by the housing 28. The shift member 82 is pivotally mounted on the shaft 41 in coaxial relation thereto and includes generally cylindrical portions 83 and 84 having therein an axial bore 85 receiving the shaft 41. The bore 85 has therein (see FIG. 2) a step defined by a wall 88 extending generally perpendicular to the axis 42. The wall 88 has therein a diametrically extending recess 90. The recess 90 houses the key 68 when the plunger 64 is in its first or outward position. The key 68 moves out of the recess 90 (upwardly in FIG. 2) when the plunger 64 moves to its second or inward position. The outer surface of the shift member portion 85 faces the inner wall 35 of the housing 28 and has therein (see FIGS. 6–9) first and second recesses 92 and 94, respectively. As shown in the drawings, the second recess 94 has a substantially greater arcuate extent than the first recess 92. The reason for the recesses 92 and 94 is explained hereinafter.

The shift member 82 is pivotally movable, in the clockwise direction as viewed in FIGS. 6–9, between a full rearward position, a rearward clutch-engaged position, a neutral position, a forward clutch-engaged position, and a full forward position. The shift member portion 83 has therein (see FIGS. 2 and 3) a radially extending aperture or recess 95 that is aligned with the recess 34 in the housing 28 when the shift member 82 is in its neutral position, and that is aligned with the aperture 48 in the shaft 41 when the shaft 41 is in its first or neutral position and the shift member 82 is in its neutral position.

The control 10 also comprises (see FIG. 2) means 96 for fixing the shift member 82 to the shaft 41 and permitting rotation of the shift member 82 relative to the housing 28 when the plunger 64 is in its outer position, and for fixing the shift member 82 to the housing 28 and permitting rotation of the shaft 41 relative to the shift member 82 when the plunger 64 is in its inward position. In the preferred embodiment, the means 96 includes the key 68 and the recess 90. When the plunger 64 is in its outward position, the key 68 is received in the recess 90 and thereby fixes the shift member 82 to the shaft 41 for common rotation therewith. When the plunger 64 is in its inward position, the key 68 is located outwardly of the recess 90 and thereby permits rotation of the shaft 41 relative to the shift member 82.

The means 96 also includes (see FIGS. 2 and 3) a member or ball 98 at least partially housed in the aperture 95 in the shift member 82, and means for moving the ball 98 radially outwardly of the aperture 95 and into the recess 34 in the housing 28 when the shift member 82 is in its neutral position and in response to movement of the plunger 64 to its inward position. While various suitable means can be used for moving the ball 98 outwardly, in the illustrated construction, such means includes a second ball 100 partially housed in the aperture 48 in the shaft 41, and means for moving the second ball 100 radially outwardly and into engagement with the first ball 98 when the shift member 82 is in its neutral position, when the shaft 41 is in its neutral position, and in response to movement of the plunger 64 to its inward position. Preferably, the means for moving the second ball 100 radially outwardly includes the plunger 64. More particularly, as shown in FIG. 2, when the plunger 64 is in its outward position, the circumferential groove 66 is aligned with the aperture 48 in the shaft 41 and the inner ball 100 extends into the groove 66. Movement of the plunger 64 to its inward position (upwardly in FIG. 2) moves the groove 66 out of alignment with the aperture 48 so that the plunger 64 moves the inner ball 100 radially outwardly and thereby moves the outer ball 98 radially outwardly and into the recess 34 in the housing 28. This is shown in FIG. 3.

The control 10 also comprises (see FIGS. 2 and 6–9) a shift lever 102 supported by the housing 28 for pivotal movement relative thereto about the axis 42. The shift lever 102 is movable, in the clockwise direction as viewed in FIG. 6, between a rearward clutch-engaged position, a neutral position, and a forward clutch-engaged position. The shift lever 102 has thereon a pair of outwardly extending arms 104 each having therein apertures 106 and 108. As explained hereinafter, the two arms 104 permit arrangement of the control 10 for either right-handed or left-handed operation.

Figure 7:
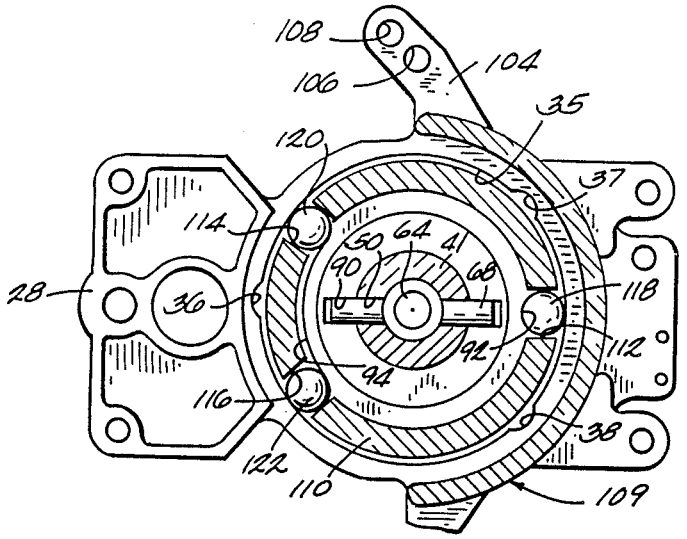
FIG. 7 is a view taken along line 7—7 in FIG. 2.
Figure 6:
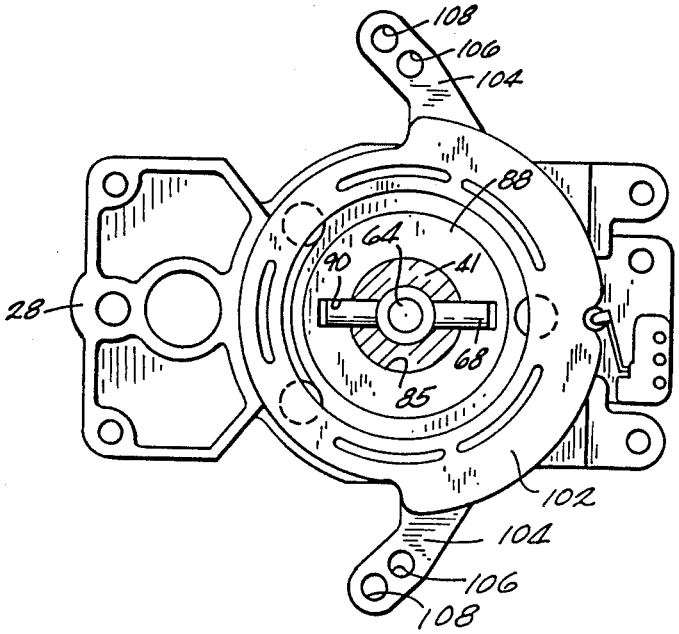
FIG. 6 is a view taken along line 6—6 in FIG. 2.
Figure 8:
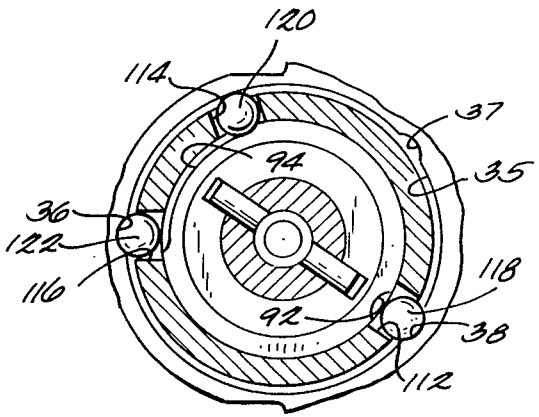
FIG. 8 is a view similar to FIG. 7 and showing the shift member in its forward clutch engaged position.
Figure 9:
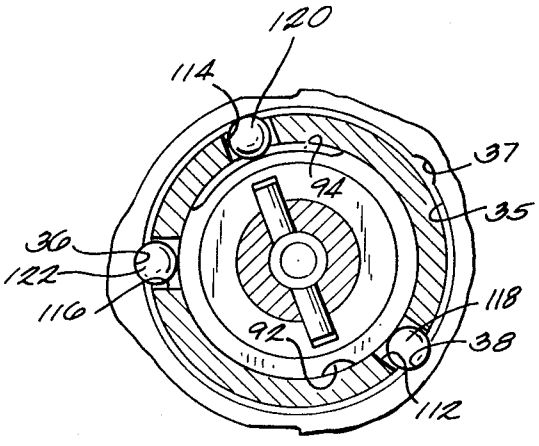
FIG. 9 is a view similar to FIG. 7 and showing the shift member in its full forward position.

The control 10 also comprises (see FIGS. 7–9) means 109 for fixing the shift lever 102 to the shift member 82 when the shift member 82 is between the forward clutch-engaged position and the rearward clutch-engaged position, and for permitting rotation of the shift member 82 relative to the shift lever 102 when the shift member 82 is between the forward clutch-engaged position and the full forward position and between the rearward clutch-engaged position and the full rearward position. While various suitable means 109 can be employed, in the preferred embodiment, the means 109 is substantially identical to the arrangement disclosed in U.S. Pat. No. 4,648,497, which is incorporated herein by reference. Specifically, as shown in FIGS. 7–9, the shift lever 102 includes an annular portion 110 surrounding the shift member 82 and having therein recesses 112, 114, and 116, and the means 109 includes rollers 118, 120, and 122 respectively housed in the recesses 112, 114, and 116. The roller 118 extends into the recess 92 in the shift member 82 when the shift member 82 is in its neutral position, and the rollers 120 and 122 extend into the recess 94 in the shift member 82 when the shift member 82 is in neutral.

When the shift member 82 is between its forward clutch-engaging position and its rearward clutch-engaging position, as shown in FIG. 7, the rollers 118, 120 and 122 engage the shift member 82 and the shift lever 102 and thereby prevent relative pivotal movement between the shift member 82 and the shift lever 102.

When the shift member 82 is in its forward clutch-engaging position, as shown in FIG. 8, the shift lever 102 is in its forward clutch-engaging position, the roller 118 is aligned with the recess 38 in the housing 28, and the roller 122 is aligned with the recess 36 in the housing 28. Because the shift lever 102 cannot move beyond its forward clutch-engaging position in the direction away from its neutral position, movement of the shift member 82 from its forward clutch-engaging position to its full forward position cams the roller 118 out of the recess 92 in the shift member 82 and into the recess 38 in the housing 28, and cams the roller 122 out of the recess 94 in the shift member 82 and into the recess 36 in the housing. This is shown in FIGS. 8 and 9. Also, during movement of the shift member 82 from its forward clutch-engaging position to its full forward position, as shown in FIG. 9, the roller 120 remains in the recess 94 in the shift member 82 but moves from one end of the recess 94 toward the other. As a result, the rollers 118, 120 and 122 permit pivotal movement of the shift member 82 relative to the shift lever 102, so that the shift member 82 can move to its full forward position.

When the shift member 82 is in its rearward clutch-engaging position (not shown), the shift lever 102 is in its rearward clutch-engaging position, the roller 118 is aligned with the recess 37 in the housing 28, and the roller 120 is aligned with the recess 36 in the housing 28. Because the shift lever 102 cannot move beyond its rearward clutch-engaging position in the direction away from its neutral position, movement of the shift member 82 from its rearward clutch-engaging position to its full rearward position cams the roller 118 out of the recess 92 in the shift member 82 and into the recess 37 in the housing 28, and cams the roller 120 out of the recess 94 in the shift member 82 and into the recess 36 in the housing 28. Also, during movement of the shift member 102 from its rearward clutch-engaging position to its full rearward position, the roller 122 remains in the recess 94 in the shift member 82 but moves from one end of the recess 94 toward the other.

The control 10 also comprises (see FIGS. 1, 2, 4 and 5) a support plate 124 mounted on the housing 28 by means described hereinafter. The plate 124 has opposite sides and has therein four apertures 128 extending between the opposite sides, and four pairs of crescent-shaped apertures 130 extending between the opposite sides, with each pair of apertures 130 being associated with one of the apertures 128. The support plate 124 also has therein (see FIG. 2) a circular aperture 132 which is centered on the axis 42 and through which the shaft 41 extends, and an elongated aperture 134 aligned with the bores 39 and 40 in the housing 28.

The control 10 also comprises (see FIG. 2) a spacer 136 mounted on the housing 28 so that the support plate 124 is sandwiched between the spacer 136 and the housing 28. The spacer 136 is secured to the housing 28 by screws 138 extending through the spacer 136 and the support plate 124 and into the housing 28. The spacer 136 includes a generally cylindrical projection 140 having therein a bore 141 and extending through the elongated aperture 134 and into the cylindrical bore 39 in the housing 28, and a generally cylindrical projection 142 extending through the opening 132 in the support plate 124. The projection 142 extends inside the shift lever 102 and has thereon an annular projection 144 extending inside the shift member 82.

The control 10 also comprises (see FIGS. 2, 4 and 5) a friction shoe 146 which is mounted on one end of the spacer 136 and which captures a portion of the plate 52 between the shoe 146 and the spacer 136. Bolts 147 extend through the shoe 146, the spacer 136, the plate 124 and the housing 28 to secure those elements to each other.

The control 10 also comprises (see FIGS. 2 and 4) a throttle cam or member 148 supported by the housing 28 for translational movement relative thereto along a line 150 substantially perpendicular to and intersecting the axis 42. The throttle cam 148 has therein first, second, and third slots 152, 154, and 156, respectively, and a cam slot 158 located intermediate the slots 154 and 156. The cam slot 158 includes an arcuate central portion 160 having the axis 42 as its center of curvature, and opposite outer, substantially linear portions 162. The throttle cam 148 also has therein cam slots 164 and 166.

The control 10 also comprises (see FIGS. 2 and 4) means for guiding movement of the throttle cam 148 relative to the housing 28 and including first, second, and third guide means 168, 170, and 172 respectively received in the slots 152, 154, and 156. While various suitable guide means can be employed, in the preferred embodiment, the first guide means 168 includes a generally cylindrical bushing 174 received in the slot 154 and secured to the support plate 124 by a washer 176, a bolt 178, and a nut 180. The second guide means 170 preferably includes a generally cylindrical projection 182 which is an integral part of the spacer 136 and which is received in the slot 154. The third guide means 172 preferably includes the reduced-diameter portion 45 of the shaft 41, which is received in the slot 156. An annular spacer 184 surrounds the shaft 41 and is located between the throttle cam 148 and the shoulder 46 on the shaft 41.

The means for guiding movement of the throttle cam 148 preferably also includes friction means for resisting movement of the throttle cam 148 relative to the housing 28. While various suitable friction means can be employed, in the preferred embodiment, such means includes (see FIGS. 2 and 4) a friction member 186 engaging the throttle cam 148, and a spring 188 exerting a force on the friction member 186 so as to bias the friction member 186 against the throttle cam 148. In the preferred embodiment, a bolt 190 extends through the friction member 186 and the spacer 136 and into the cylindrical bore 40 in the housing 28. The bolt 190 includes a head 192 located in the cylindrical bore 40, and the spring 188 extends between the spacer 136 and the head 192 of the bolt 190. A nut 194, which is held by the friction member 186 against rotation and against movement toward the head 192 of the bolt 190, threadedly engages the bolt 190 and fixes the bolt 190 relative to the friction member 186. Therefore, the spring 188 acts on the friction member 186 through the bolt 190 and the nut 194 to bias the friction member 186 toward the spacer 136 so that the throttle cam 148 is squeezed between the friction member 186 and the spacer 136.

The friction means also includes means for adjusting the length of the spring 188, which means includes the bolt 190. When the bolt 190 is rotated in one direction, the length of the spring 188 is decreased and the force exerted by the spring 188 is increased. When the bolt 190 is rotated in the other direction, the length of the spring 188 is increased and the force exerted by the spring 188 is decreased. Access to the bolt 190 is afforded by the aperture 24 in the mounting plate 12. Access to the aperture 24 is gained by removing the cover 26 from the mounting plate 12.

Figure 4:
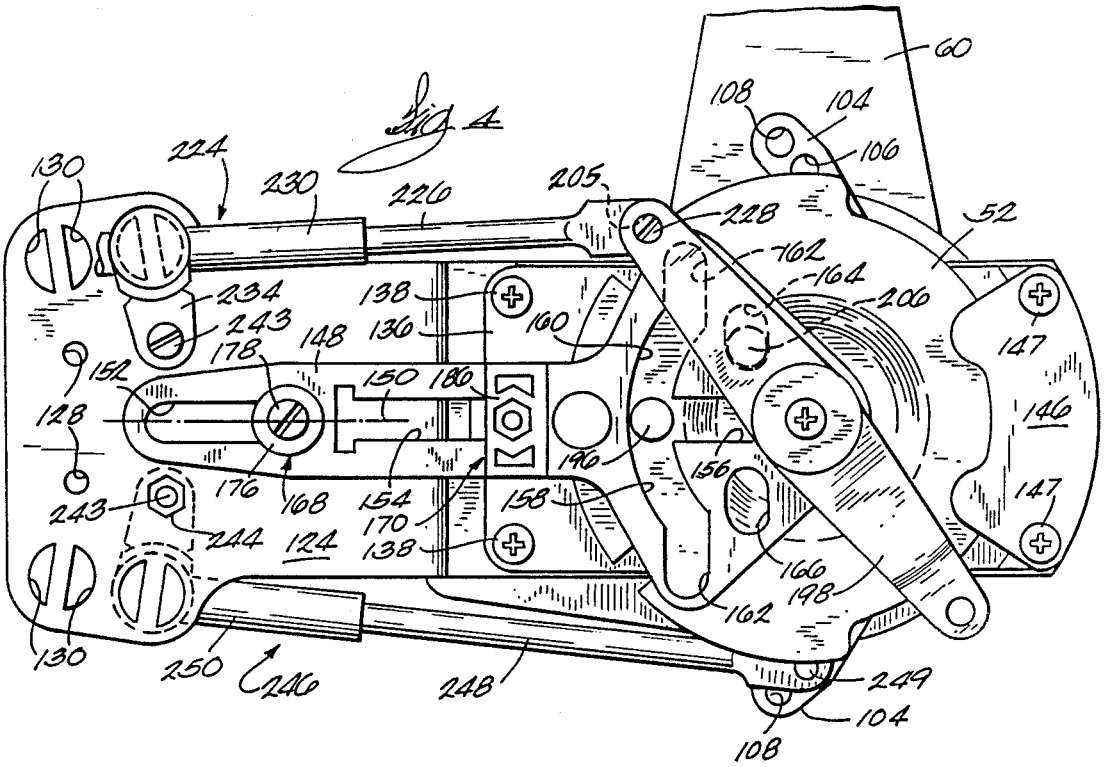
FIG. 4 is a view taken along line 4—4 in FIG. 2.

The control 10 also comprises (see FIGS. 2 and 4) means for causing movement of the throttle cam 148 relative to the housing 28 in response to pivotal movement of the shaft 41 relative to the housing 28. While various suitable means can be employed, in the preferred embodiment, such means includes a member or roller 196 fixed to the plate 52 and received in the cam slot 158. When the shaft 41 is in its neutral position, the roller 196 is located in the middle of the central portion 160 of the cam slot 158, as shown in FIG. 4. During movement of the shaft 41 between its forward clutch-engaged and rearward clutch-engaged positions, the roller 196 is located in the central portion 160 of the cam slot 158 and, because the central portion 160 is centered on the axis 42, the roller 196 does not move the throttle cam 148. During movement of the shaft 41 from its forward clutch-engaged position to its full forward position and from its rearward clutch-engaged position to its full rearward position, the roller 196 enters one of the straight portions 162 of the cam slot 158 and thereafter moves the throttle cam 148 to the left (as shown in FIG. 4) regardless of whether the shaft 41 is moving to its full forward position or to its full rearward position.

The control 10 also comprises (see FIGS. 2 and 4) a throttle lever 198 supported by the housing 28 for pivotal movement relative thereto about the axis 42. More particularly, as shown in FIG. 2, the control 10 comprises an annular spacer 200 mounted on the reduced diameter portion 45 of the shaft 41, and the throttle lever 198 is mounted on the spacer 200 for pivotal movement relative to the shaft 41. The throttle lever 198 is captured between a washer 202 and the throttle cam 148, and the washer 202 is secured to the shaft 41 by a screw 204 threaded into the shaft 41. The throttle lever 198 has therein an aperture 205 (FIG. 4) and is movable between a throttle closed position and a throttle open position.

The control 10 also comprises (see FIG. 4) means for causing pivotal movement of the throttle lever 198 in response to translational movement of the throttle cam 148. While various suitable means can be used, in the illustrated construction, such means includes a roller 206 mounted on the throttle lever 198 and received in one of the cam slots 164 and 166 in the throttle cam 148. The roller 206 is received in the cam slot 164 if the control 10 is arranged for right-handed operation, as in the illustrated construction, and is received in the cam slot 166 if the control 10 is arranged for left-handed operation. As shown in FIG. 4, movement of the throttle cam 148 to the right causes clockwise movement of the throttle lever 198 from the closed position to the open position, and movement of the throttle cam 148 to the left causes counterclockwise movement of the throttle lever 198 from the open position to the closed position.

The control 10 further comprises (see FIGS. 2 and 5) detent means exerting a force on the shaft 41 for releasably holding the shaft 41 in any one of the neutral, forward, and rearward positions. While various suitable detent means can be employed, in the preferred embodiment, such means includes a ball 208 which is supported by the spacer 136, and thus by the housing 28, and which is aligned with the recess 54 in the plate 52 when the shaft 41 is in its forward clutch-engaged position, is aligned with the middle recess 56 when the shaft is in its neutral position, and is aligned with the recess 58 when the shaft 41 is in its rearward clutch-engaged position. The detent means also includes means for biasing the ball 208 toward the plate 52 so that the ball 208 extends into an aligned one of the recesses 54, 56 and 58. In the preferred embodiment, the ball 208 is located in the bore 141 in the spacer 136, and the biasing means includes a circular shoe 210 which is located in the bore 141 and which engages the ball 208, an outer spring 212 which extends between the shoe 210 and a shoulder 214 within the bore 141, and an inner spring 216 which is located inside the outer spring 212 and which extends between the shoe 210 and a nut 218 in the bore 141.

The control 10 also comprises (see FIG. 2) means for adjusting the magnitude of the force holding the shaft 41 in its neutral position, which means preferably includes means for adjusting the length of the inner spring 216. In the preferred embodiment, the portion of the bore 141 housing the nut 218 has a non-circular cross section so that the nut 218 is prevented from rotating within the bore 141, and a bolt 220, which is rotatable within the bore 141, is threaded into the nut 218. Movement of the bolt 220 away from the shoe 210 is prevented by a second shoulder 222 within the bore 141. Accordingly, rotation of the bolt 220 in one direction causes movement of the nut 218 toward the shoe 210 and thereby reduces the length of the inner spring 216, and rotation of the bolt 220 in the other direction causes movement of the nut 218 away from the show 210 and thereby increases the length of the inner spring 216. Access to the bolt 220 is afforded by the aperture 22 in the mounting plate 12. Access to the aperture 22 in the mounting plate 12 is gained by removing the cover 26 from the mounting plate 12.

Figure 11:
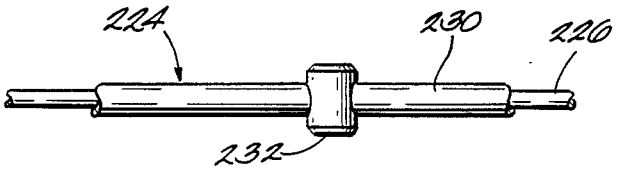
FIG. 11 is a view of a control cable.

The control 10 also comprises (see FIGS. 4 and 11) a throttle cable 224 including an inner core 226 having one end connected to the throttle lever 198 by a pin 228 extending through the aperture 205, and an opposite end (not shown) adapted to be operably connected to a throttle (not shown). The throttle cable 224 also includes an outer sleeve or sheath 230 surrounding the core 226 and having fixed thereto a generally cylindrical trunnion 232.

Figure 14:
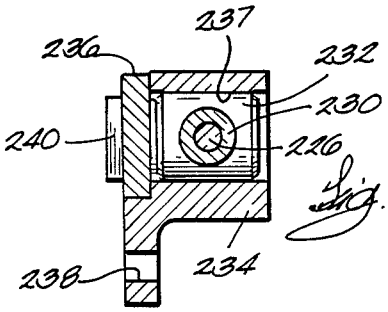
FIG. 14 is a cross-sectional view of an assembly for supporting the control cable shown in FIG. 11.
Figure 18:
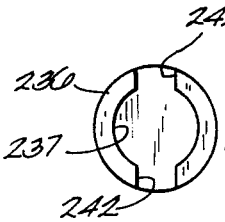
FIG. 18 is a top plan view of one of the members shown in FIG. 16.
Figure 19:
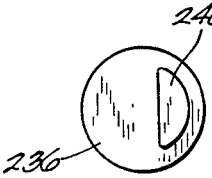
FIG. 19 is a bottom plan view of the supporting member shown in FIG. 18.

The control 10 further comprises (see FIGS. 4 and 14) means for securing the trunnion 232 to the plate 124, and thus to the housing 28, for pivotal movement relative thereto. While various suitable securing means can be employed, in the preferred embodiment, such means includes means for pivotably supporting the trunnion 232. The supporting means preferably includes members 234 and 236 each partially defining a generally cylindrical pocket 237 for housing the trunnion 232. The member 234 has therein an aperture 238 aligned with the an aperture 128, and the member 236 has thereon a crescent-shaped projection 240 received in an aperture 130. The member 234 has thereon projections 241 received in recesses 242 in the member 236 so that the member 234 cannot pivot relative to the member 236. The member 234 also has therein diametrically opposed slots 245 through which the cable 224 extends. The means for securing the trunnion 232 to the plate 124 also includes means for fixing the supporting means, i.e., the members 234 and 236, to the plate 124. In the preferred embodiment, this means includes connecting means extending through the apertures 128 and 138 for securing the member 234 to the plate 124. The connecting means preferably includes a bolt 243 and a nut 244. The nut 244 and bolt 243 prevent the members 234 and 236 from moving away from the plate 124, and the combination of the bolt 243 extending through the aperture 128 and the projection 240 extending into the aperture 130 prevents translational and pivotal movement of the members 234 and 236 relative to the plate 124.

Movement of the throttle lever 198 from its closed position to its open position acts through the inner core 226 to open the throttle. Movement of the throttle lever 198 from its open position to its closed position acts through the inner core 226 to close the throttle.

The control 10 further comprises (see FIGS. 4) a shift cable 246 which is substantially identical to the throttle cable 224. The cable 246 includes an inner core 248 having one end connected to the shift lever 102 by a pin 249 extending through an aperture 106, and an opposite end (not shown) adapted to be operably connected to a clutch (not shown), and an outer sleeve or sheath 250 surrounding the core 248 and having fixed thereto a generally cylindrical trunnion (not shown).

The control 10 further comprises means for securing the trunnion on the shift cable 246 to the plate 124 for pivotal movement relative thereto. This securing means preferably includes additional members 234 and 236. The securing means also includes a bolt 243 and a nut 244.

Movement of the shift lever 102 from its neutral position to its forward clutch-engaged position acts through the inner core 248 to shift the clutch from neutral into forward, and movement of the shift lever 102 from its forward clutch-engaged position to its neutral position acts through the inner core 248 to shift the clutch into neutral. Movement of the shift lever 102 from its neutral position to its rearward clutch-engaged position acts through the inner core 248 to shift the clutch from neutral into reverse, and movement of the shift lever 102 from its rearward clutch-engaged position to its neutral position acts through the inner core 248 to shift the clutch into neutral.

The throttle lever 198 is located on the upper side (as seen in FIG. 4) of the support plate 124, and the throttle cable 224 is therefore located on the upper side of the support plate 124. Since the illustrated control 10 is arranged for right-handed operation, the roller 206 is received in the cam slot 164 and the throttle cable 224 is connected to the upper end (as shown in FIG. 4) of the throttle lever 198. If the control 10 were arranged for left-handed operation, the roller 206 would be received in the cam slot 166 and the throttle cable 224 would be connected to the lower end (as viewed in FIG. 4) of the throttle lever 198. The shift lever 102 is located on the lower side (as seen in FIG. 4) of the support plate 124, and the shift cable 246 is therefore located on the lower side of the support plate 124. Also, since the illustrated control 10 is arranged for right-handed operation, the shift cable 246 is connected to the lower arm 104 (as viewed in FIG. 4) of the shift lever 102. If the control 10 were arranged for left-handed operation, the shift cable 246 would be connected to the upper arm 104 of the shift lever 102.

It should be noted that the apertures 128 and 130 in the support plate 124 permit location of an assembly of a member 234 and a member 236 on either side of the support plate 124. The four sets of apertures 128 and 130 permit the control 10 to be arranged for either right-handed or left-handed operation. Furthermore, the apertures 128 and 130 located closest to the axis 42 are used in connection with throttle and shift cables having a permanent trunnion 232. Such cables are sold by Outboard Marine Corporation, the assignee hereof. The apertures 128 and 130 farthest from the axis are used in connection with SAE-type shift and throttle cables, which are explained hereinafter.

The control 10 operates as follows. Movement of the handle 60 from its neutral position to its forward clutch-engaging position operates, as described above, to move the shift member 82 to its forward clutch-engaged position and to move the shift lever 102 to its forward clutch-engaged position. This shifts the clutch into forward. Movement of the handle 60 to its forward clutch-engaged position does not move the throttle lever 198 and therefore does not open the throttle. Movement of the handle 60 from its forward clutch-engaged position to its full forward position operates, as described above, to move the shift member 82 to its full forward position and to move the throttle lever 198 to its throttle open position. The shift lever 102 does not move during movement of the handle 60 from its forward clutch-engaged position to its full forward position. Thus, movement of the handle 60 from its forward clutch-engaged position to its full forward position opens the throttle.

In a similar manner, movement of the handle 60 from its neutral position to its rearward clutch-engaged position shifts the clutch into reverse but does not open the throttle, and movement of the handle 60 from its rearward clutch-engaged position to its full rearward position opens the throttle.

In order to warm up the engine (not shown), the operator pushes in the knob 74 when the handle 60 is in its neutral position. (Misalignment of the aperture 95 in the shift member 82 with the recess 34 in the housing 28 prevents the balls 98 and 100 from moving radially outwardly and thereby prevents the operator from moving the knob 74 inwardly when the handle 60 is not in its neutral position.) Inward movement of the knob 74 moves the plunger 64 to its inward position and thereby operates, as described above, to prevent pivotal movement of the shift member 82 relative to the housing 28 and to permit pivotal movement of the shaft 41 relative to the housing 28. Accordingly, when the knob 74 is pushed in by the operator, movement of the handle 60 from its neutral position to its forward clutch-engaged position does not shift the clutch into forward. Further movement of the handle 60 from its forward clutch-engaged position to its full forward position opens the throttle. Thus, when the knob 74 is moved inwardly, the operator can advance the throttle without shifting the clutch.

Figure 12:
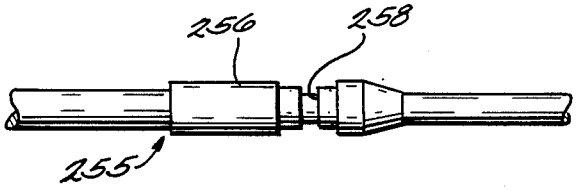
FIG. 12 is a view of an alternative control cable.
Figure 17:
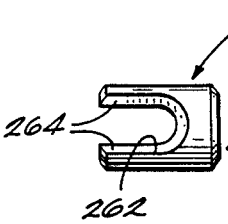
FIG. 17 is a side elevational view of one of the members shown in FIG. 16.
Figure 13:
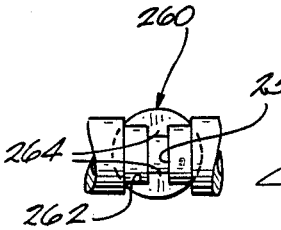
FIG. 13 is a partial, enlarged view of the cable shown in FIG. 12.
Figure 15:
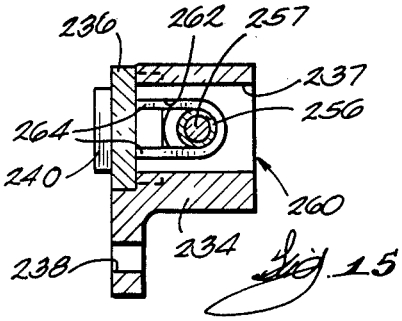
FIG. 15 is a view similar to FIG. 14 of an assembly for supporting the cable shown in FIG. 12.

A control which is an alternative embodiment of the invention is illustrated in FIGS. 12, 13, 15 and 17. In the alternative embodiment, the control comprises SAE-type shift and throttle cables 255. Each of these cables 255 includes, instead of an integral trunnion 232, an outer sleeve 256 having therein a circumferential groove 258 (FIGS. 12 and 13). Each cable 255 also includes an inner core 257. The control also comprises, for each of the cables 255, an adaptor cylinder or trunnion 260 (FIG. 17). The adaptor trunnion 260 has therein (see FIG. 13) a slot 262 receiving the sleeve 256 and having therein spaced projections 264 housed in the groove 258. The interengagement of the projections 264 and the groove 258 prevents axial movement of the adaptor trunnion 260 relative to the sleeve 256. The adaptor trunnion 260 is secured to the support plate 124 in the same manner as the trunnion 232 of the preferred embodiment is secured to the support plate 124.

It should be noted that, in the alternative embodiment, the inner core of the shift cable 255 is connected, via a pin, to an aperture 108 in the shift lever 102 instead of an aperture 106.

Various features of the invention are set forth in the following claims.

I claim:

1. A single lever control comprising a housing having therein a recess, a shaft pivotably supported by said housing and having therein an axial bore, a shift member pivotably supported by said housing coaxially with said shaft and adapted to be operably connected to a clutch, said shift member being movable relative to a neutral position and having therein a recess located radially inwardly of said first recess and aligned with said recess in said housing when said shift member is in said neutral position, a plunger housed in said bore for movement axially of said shaft between first and second positions, and means for fixing said shift member to said shaft and permitting rotation of said shift member relative to said housing when said plunger is in said first position, and for fixing said shift member to said housing and permitting rotation of said shaft relative to said shift member when said plunger is in said second position, said means including a member at least partially housed in said recess in said shift member, and means for moving said member radially outwardly of said recess in said shift member and into said recess in said housing when said shift member is in said neutral position and a response to movement of said plunger to said second position.

2. A single lever control as set forth in claim 1 wherein said member is a ball.

3. A single lever control as set forth in claim 2 wherein said shift member has therein an axial bore receiving said shaft and has therein a radially extending aperture defining said recess in said shift member and communicating with said bore in said shift member.

4. A single lever control as set forth in claim 3 wherein said shaft is movable relative to a first position and has therein a radially extending aperture communicating with said bore in said shaft and being aligned with said aperture in said shift member when said shift member is in said neutral position and said shaft is in said first position, and wherein said means for moving said ball radially outwardly includes a second ball partially housed in said aperture in said shaft, and means for moving said second ball radially outwardly and into engagement with said first-mentioned ball when said shift member is in said neutral position, when said shaft is in said first position, and in response to movement of said plunger to said second position.

5. A single lever control as set forth in claim 4 wherein said plunger has therein an annularly extending groove aligned with said aperture in said shaft when said plunger is in said first position, and wherein said second ball extends into said groove when said plunger is in said first position.

6. A single lever control as set forth in claim 1 wherein said shift member has therein a diametrically extending recess, wherein said plunger has thereon a diametrically extending key housed in said recess when said plunger is in said first position, and wherein said means includes said recess and said key.

7. A single lever control as set forth in claim 1 wherein said shaft is movable relative to a neutral position, and wherein said control further comprises detent means exerting a force on said shaft for releasably holding said shaft in said neutral position, and means for adjusting the magnitude of said force.

8. A single lever control as set forth in claim 1 wherein said shaft is movable between a forward position, a neutral position, and a rearward position and has therein first, second, and third recesses, said second recess being larger than said first and third recesses, and wherein said control further comprises a ball which is supported by said housing and which is aligned with said first recess when said shaft is in said forward position, is aligned with said second recess when said shaft is in said neutral position, and is aligned with said third recess when said shaft is in said rearward position, and means for biasing said ball toward said member so that said ball extends into an aligned one of said recesses.

9. A single lever control as set forth in claim 1 wherein said shaft is pivotable about an axis, and wherein said control further comprises a throttle member supported by said housing for translational movement relative thereto along a line substantially perpendicular to and intersecting said axis, said throttle member being adapted to be operably connected to a throttle, and friction means for resisting movement of said throttle member.

10. A single lever control as set forth in claim 1 and further comprising a throttle member movably supported by said housing and adapted to be operably connected to a throttle, means for guiding movement of said throttle member relative to said housing and including friction means for resisting movement of said throttle member relative to said housing, and means for causing movement of said throttle member relative to said housing in response to pivotal movement of said shaft relative to said housing.

11. A single lever control as set forth in claim 1 and further comprising a throttle member movably supported by said housing and adapted to be operably connected to a throttle, means for causing movement of said throttle member relative to said housing in response to pivotal movement of said shaft relative to said housing, and friction means for resisting movement of said throttle member relative to said housing, said friction means including a friction member engaging said throttle member, a spring exerting a force on said friction member so as to bias said friction member against said throttle member, and means for adjusting the length of said spring.

12. A single lever control as set forth in claim 1 and adapted to be connected to a control cable including an inner core, and an outer sleeve surrounding the core and having fixed thereto a generally cylindrical trunnion, wherein said shift member is adapted to be operably connected to the inner core of the cable, and wherein said control further comprises means for securing the trunnion to said housing for pivotal movement relative thereto, said securing means including first and second members each partially defining a generally cylindrical pocket for housing the trunnion, and means for fixing said first and second members relative to said housing.

13. A single lever control as set forth in claim 1 and further comprising a cable including an inner core adapted to be operably connected to a clutch, an outer sleeve surrounding said core, and a generally cylindrical trunnion removably secured to said sleeve against axial movement relative thereto, and means for securing said trunnion to said housing for pivotal movement relative thereto, and wherein said shaft is operably connected to said core.

14. A single lever control as set forth in claim 1 and adapted to be connected to a control cable including an inner core, and an outer sleeve surrounding the core and having fixed thereto a generally cylindrical trunnion, said single lever control further comprising a support plate fixed to said housing and having therein spaced first and second apertures, means for supporting the trunnion, said supporting means having therein a third aperture aligned with said first aperture and having thereon a projection received in said second aperture, and connecting means extending through said first and third apertures for securing said supporting means to said plate, and wherein said shaft is adapted to be operably connected to the core of the cable.

15. A single lever control as set forth in claim 1 wherein said shaft is supported by said housing for pivotal movement relative thereto about an axis, and wherein said control further comprises a throttle member supported by said housing for translational movement relative thereto, means for moving said throttle member in response to pivotal movement of said shaft, a throttle lever supported by said housing for pivotal movement relative thereto about said axis and adapted to be operably connected to a throttle, and means for causing pivotal movement of said throttle lever in response to movement of said throttle member.

16. A single lever control as set forth in claim 1 and further comprising a throttle member movably supported by said housing and adapted to be operably connected to a throttle, said throttle member having therein first and second slots, and a cam slot located intermediate said first and second slots, means for guiding movement of said throttle member relative to said housing and including first and second guide means supported by said housing and respectively received in said first and second slots, and means for causing movement of said throttle member relative to said housing in response to pivotal movement of said shaft relative to said housing, said means for causing movement of said throttle member including a member fixed to said shaft for common movement therewith and received in said cam slot.

17. A single lever control comprising a housing, a shaft pivotably supported by said housing and having therein an axial bore, a shift member coaxial with said shaft and adapted to be operably connected to a clutch, a plunger housed in said bore for movement axially of said shaft between outward and inward positions, and means for fixing said shift member to said shaft and permitting rotation of said shift member relative to said housing when said plunger is in said outward position, and for fixing said shift member to said housing and permitting rotation of said shaft relative to said shift member when said plunger is in said inward position, said means including a member which directly engages both said housing and said shift member when said plunger is in said inward position.

18. A single lever control comprising a housing, a lever supported by said housing for pivotal movement relative to a neutral position and adapted to be operably connected to a clutch, detent means exerting a force on said lever for releasably holding said lever in said neutral position, and means for adjusting the magnitude of said force.

19. A single lever control as set forth in claim 18 and further comprising a shaft fixed to said lever for common movement therewith, said shaft having therein a recess, and wherein said detent means includes a ball supported by said housing and aligned with said recess when said lever is in said neutral position, and means for biasing said ball into said recess.

20. A single lever control as set forth in claim 19 wherein said biasing means includes a spring engaging said ball, and wherein said adjusting means includes means for adjusting the length of said spring.

21. A single lever control as set forth in claim 20 wherein said means for adjusting the location of said second end of said spring includes a screw rotatably supported by said housing.

22. A single lever control comprising a housing, a lever supported by said housing for pivotal movement between a forward position, a neutral position, and a rearward position, a shaft fixed to said lever for common movement therewith, said shaft having therein first, second, and third recesses, said second recess being larger than said first and third recesses, a ball which is supported by said housing and which is aligned with said first recess when said lever is in said forward position, is aligned with said second recess when said lever is in said neutral position, and is aligned with said third recess when said lever is in said rearward position, and means for biasing said ball toward said member so that said ball extends into an aligned one of said recesses.

23. A single lever control comprising a housing, a lever supported by said housing for pivotal movement relative thereto about an axis, a throttle member supported by said housing for translational movement relative thereto along a line substantially perpendicular to and intersecting said axis, said throttle member being adapted to be operably connected to a throttle, and friction means for resisting movement of said throttle member.

24. A single lever control comprising a housing, a lever supported by said housing for pivotal movement relative thereto, a throttle member movably supported by said housing and adapted to be operably connected to a throttle, means for guiding movement of said throttle member relative to said housing and including friction means for resisting movement of said throttle member relative to said housing, and means for causing movement of said throttle member relative to said housing in response to pivotal movement of said lever relative to said housing.

25. A single lever control comprising a housing, a lever supported by said housing for pivotal movement relative thereto, a throttle member movably supported by said housing and adapted to be operably connected to a throttle, means for causing movement of said throttle member relative to said housing in response to pivotal movement of said lever relative to said housing, and friction means for resisting movement of said throttle member relative to said housing, said friction means including a friction member engaging said throttle member, a spring exerting a force on said friction member so as to bias said friction member against said throttle member, and means for adjusting the length of said spring.

26. A single lever control adapted to be connected to a control cable including an inner core, and an outer sleeve surrounding the core and having fixed thereto a generally cylindrical trunnion, said single lever control comprising a housing, a lever supported by said housing for pivotal movement relative thereto and adapted to be operably connected to the inner core of the cable, and means for securing the trunnion to said housing for pivotal movement relative thereto, said securing means including first and second members each partially defining a generally cylindrical pocket for housing the trunnion, and means for fixing said first and second members relative to said housing.

27. A single lever control as set forth in claim 26 wherein said control further comprises a plate which is fixedly secured to said housing and which has therein spaced first and second apertures, wherein said first member has therein a third aperture aligned with said first aperture, wherein said second member has thereon a projection received in said second aperture, and wherein said means for fixing said first and second members relative to said housing includes connecting means extending through said first and third apertures for securing said first member to said plate.

28. A single lever control comprising a housing, a cable including an inner core adapted to be operably connected to clutch, an outer sleeve surrounding said core and having therein a circumferential groove, and a generally cylindrical trunnion removably secured to said sleeve against axial movement relative thereto and having therein a slot receiving said sleeve and spaced projections received in said groove, means for securing said trunnion to said housing for pivotal movement relative thereto, and a lever supported by said housing for pivotal movement relative thereto and operably connected to said core.

29. A single lever control adapted to be connected to a control cable including an inner core, and an outer sleeve surrounding the core and having fixed thereto a generally cylindrical trunnion, said single lever control comprising a support plate having therein spaced first and second apertures, a lever supported by said plate for pivotal movement relative thereto and adapted to be operably connected to the core of the cable, means for supporting the trunnion, said supporting means having therein a third aperture aligned with said first aperture and having thereon a projection received in said second aperture, and connecting means extending through said first and third apertures for securing said supporting means to said plate.

30. A single lever control as set forth in claim 29 wherein said plate has opposite sides, wherein said first and second apertures extend between said opposite sides, and wherein said supporting means is securable to either of said sides.

31. A single lever control comprising a housing, a control lever supported by said housing for pivotal movement relative thereto about an axis, a throttle member supported by said housing for translational movement relative thereto, means for moving said throttle member in response to pivotal movement of said control lever, a throttle lever supported by said housing for pivotal movement relative thereto about said axis and adapted to be operably connected to a throttle, and means for causing pivotal movement of said throttle lever in response to movement of said throttle member.

32. A single lever control as set forth in claim 32 and further comprising a shaft fixed to said control lever for common movement therewith, said shaft having thereon a roller, wherein said throttle member has therein a cam slot receiving said roller, and wherein said means for moving said throttle member in response to pivotal and said cam slot.

33. A single lever control comprising a housing, a control lever supported by said housing for pivotal movement relative thereto, a throttle member movably supported by said housing and adapted to be operably connected to a throttle, said throttle member having therein first and second slots, and a cam slot located intermediate said firs t and second slots, means for guiding movement of said throttle member relative to said housing and including first and second guide means supported by said housing and respectively received in said first and second slots, and means for causing movement of said throttle member relative to said housing in response to pivotal movement of said lever relative to said housing, said means for causing movement of said throttle member including a member fixed to said lever for common movement therewith and received in said cam slot.

34. A single lever control as set forth in claim 34 and further comprising a shaft pivotably supported by said housing and fixed to said control lever for common movement therewith, wherein said member is fixed to said shaft, and wherein one of said guide means includes said shaft.

* * * * *